United States Patent [19]

van Heijst

[11] 4,029,039

[45] June 14, 1977

[54] MOORING MEANS, PARTICULARLY FOR CARRYING OUT PRODUCTION TESTS FOR GAS AND OIL DRILLING ON THE HIGH SEAS

[75] Inventor: Willem Jan van Heijst, Monte-Carlo, Monaco

[73] Assignee: N.V. Industrieele Handelscombinatie Holland, Rotterdam, Netherlands

[22] Filed: Oct. 31, 1975

[21] Appl. No.: 627,913

[30] Foreign Application Priority Data

Nov. 5, 1974 Netherlands ..... 7414432

[52] U.S. Cl. ..... 114/230; 9/8 P

[51] Int. Cl.[2] ..... B63B 21/52

[58] Field of Search ..... 114/230, 206 R; 9/8 P, 9/8 R; 141/387, 388

[56] References Cited

UNITED STATES PATENTS

| | | | |
|---|---|---|---|
| 2,882,536 | 4/1959 | Jordan | 9/8 P |
| 3,155,069 | 11/1964 | Ross et al. | 9/8 P |
| 3,348,517 | 10/1967 | Johnson, Jr. et al. | 114/206 R |
| 3,442,245 | 5/1969 | Christians et al. | 9/8 P |
| 3,529,919 | 9/1970 | Tiraspolsky et al. | 114/206 R |
| 3,916,812 | 11/1975 | Bartels | 114/230 |

FOREIGN PATENTS OR APPLICATIONS

| | | | |
|---|---|---|---|
| 1,080,189 | 8/1967 | United Kingdom | 114/206 R |
| 1,384,983 | 2/1975 | United Kingdom | 114/230 |

*Primary Examiner*—Trygve M. Blix
*Assistant Examiner*—Stuart M. Goldstein
*Attorney, Agent, or Firm*—Young & Thompson

[57] ABSTRACT

A mooring system for carrying out production tests for gas and oil drilling on the high seas, comprises a vessel with rigid arms pivotally interconnected therewith for relative vertical swinging movement. The arms are connected with a slender vertical buoy by universal joint, and a float is connected to the arms at a distance from the buoy. The buoy has a taut but flexible connection with an underlying anchor on the sea floor.

6 Claims, 3 Drawing Figures

MOORING MEANS, PARTICULARLY FOR CARRYING OUT PRODUCTION TESTS FOR GAS AND OIL DRILLING ON THE HIGH SEAS

This invention relates to a mooring means, particularly for carrying out production tests for gas and oil-drilling at high sea. Such special means are not yet known. Known heretofore are mooring means in general, which are not very well suited for carrying out production tests. Normally when oil- and gasfields are detected it is more or less arbitrarily decided whether to place a permanent production installation or not. This decision is guided by the obtained information considering geological formation, as well as by information obtained by the drilling itself and contingent foregoing drillings in adjacent areas. These data lead to estimations on expected stocks, but it is unknown whether the well drilled will have an output justifying the placement of a permanent production means.

It is therefore an object of the invention to provide means with which it is possible to temporarily carry out production tests. Such means should not be very costly, must be removable quickly and easily and must be adapted to be coupled and uncoupled quickly and easily.

This object is achieved according to the invention, because the means consist in a buoy, which is positionable in the vicinity of the well by means of an anchor, said buoy carrying a pipeline, extending downward towards the well, as well as a hose initiating at the buoy, which is coupled to the pipeline in the buoy by means of a turnable coupling, said buoy being coupled to a vessel by means of rigid arms, having with the vessel a joint about a horizontal axis, said arms being attached to a float, with which it is possible to impose a vertically directed force on the buoy. The attachment of the arms to the float can be rigid or by means of a joint. The buoy and anchor are parts which are easy to detach and by which the pipeline can be connected to the well via a hose. Attached to the rigid arms, the vessel carries a float and when these arms are attached to the buoy and an upward directed force is imposed on the buoy by increasing its buoyancy, a stable means is formed, which however is capable of following the movement of the waves. The connection between the buoy and the arms consists preferably in a hookcoupling.

It is known to use buoys for transporting oil to and from fluid carrying vessels. Also it has already been proposed in the published Dutch patent application No. 72.07903 to couple such a buoy to a vessel by way of rigid arms, having with the vessel a joint link with a horizontal axis.

The invention differs from the state of art in that the rigid arms attached to the vessel via a horizontal joint axis, carry a float, which can be coupled to the buoy in a way which makes it possible for the buoy to move in every direction and which can impose an upwardly directed force on the buoy.

Preferably the buoy consists in a vertical cylinder, with adjustable buoyancy, whereby the buoy has a substantial vertical connection with the anchor. The buoyancy of the buoy ensures a taut connection between the buoy and the anchor and this buoy is little influenced by the action of the waves, because of the large draft and the small diameter at the surface. This buoyancy, together with the upward force, which can be imposed on it by the float, provide a horizontal force component, which counteracts movement, with horizontal movements of the device.

Preferably the anchor is a suction anchor, which is provided with jet pumps, by means of which the sucking action is carried out. Such a suction anchor can be placed easily as well as moved.

Further according to the invention, it is possible for the coupling with the vessel, the coupling with the buoy and the virtual centre of rotation of the float, to be in the same horizontal plane. In this way movements of the watersurface are smoothly followed by the device, because, at first the vertical movements are not accompanied by horizontal movements.

Further according to the invention, it is possible for the coupling with the vessel, the buoy and the float, to be below the watersurface. All joints are then below the watersurface, whereby buoy and float have a buoyancy which is constant, though dependent on the way in which one or both are ballasted. In this way an adaption to different waveconditions is possible.

The invention will now more fully be described, referring to the drawings, wherein.

Figure 1:
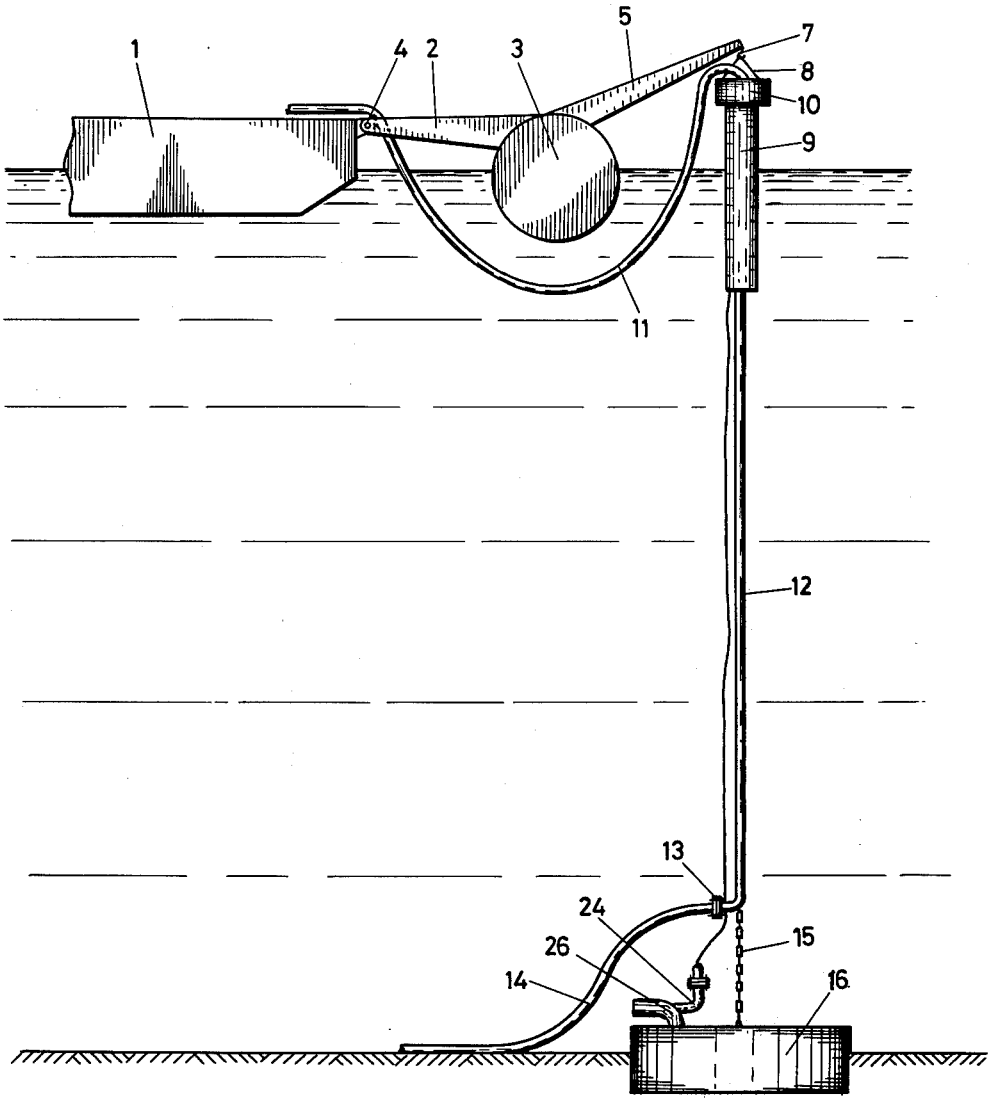
FIG. 1 shows an embodiment, in schematic side elevational view.

The device shown in FIG. 1 consists in a vessel 1 in the form of a fluid carrying vessel or tanker, provided with storage tanks and necessary equipment. On one end of the vessel, it is provided with a pair of arms 2, which are rigidly connected to a cylindrical float 3. At 4 the arms are jointly attached to a horizontal joint axis. Directed away from the tanker are a pair of arms 5, which meet at 6 and share at that place a coupling 7. This coupling connects with a brace 8 at the top of the buoy 9, which is in the form of a slender cylinder. The brace 8 can be attached to a turnable upper part 10, in which also a turnable coupling (not shown) is provided, which with coupling 7, allows movement in every direction and thus acts as a universal joint means. This turntable coupling couples hose 11 and other hoses and lines to a pipeline 12, suspended in the buoy, which extends vertically downward and is at its lower end provided with a flange coupling 13 for the connection with the tube 14 coming from the well and which is further provided with a chain 15 at this end, for the connection with the anchor 16.

Preferably, this anchor is a suction anchor. Such an anchor can be provided with jetpumps, by means of which it is possible to press it with great force against the bottom.

The cylindrical float 9 has an adjustable buoyancy, so that after the placement and the securing of the anchor, the connection between the buoy and the anchor can be a taut one. Because of the connection of the buoy with the vessel 1 via arms 2 and 5 and with the float 3, movements in a horizontal direction create a further submersion of buoy and float, whereby a horizontal forcecomponent is originated, which counteracts said movements.

Figure 2:
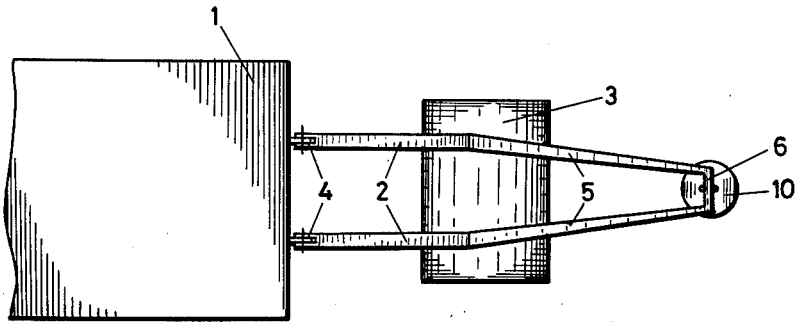
FIG. 2 shows a top plan view of FIG. 1.

In the embodiment of FIGS. 1 and 2 the float 3 is placed between the vessel and the buoy 9. The float 3 has an adjustable buoyancy, so that at coupling 7 it is possible to impose with the float an upwardly directed force on the buoy. In this way the float 3 and the buoy 9 form a unit, which is flexible, so that adaption to the movement of the water is possible.

Figure 3:
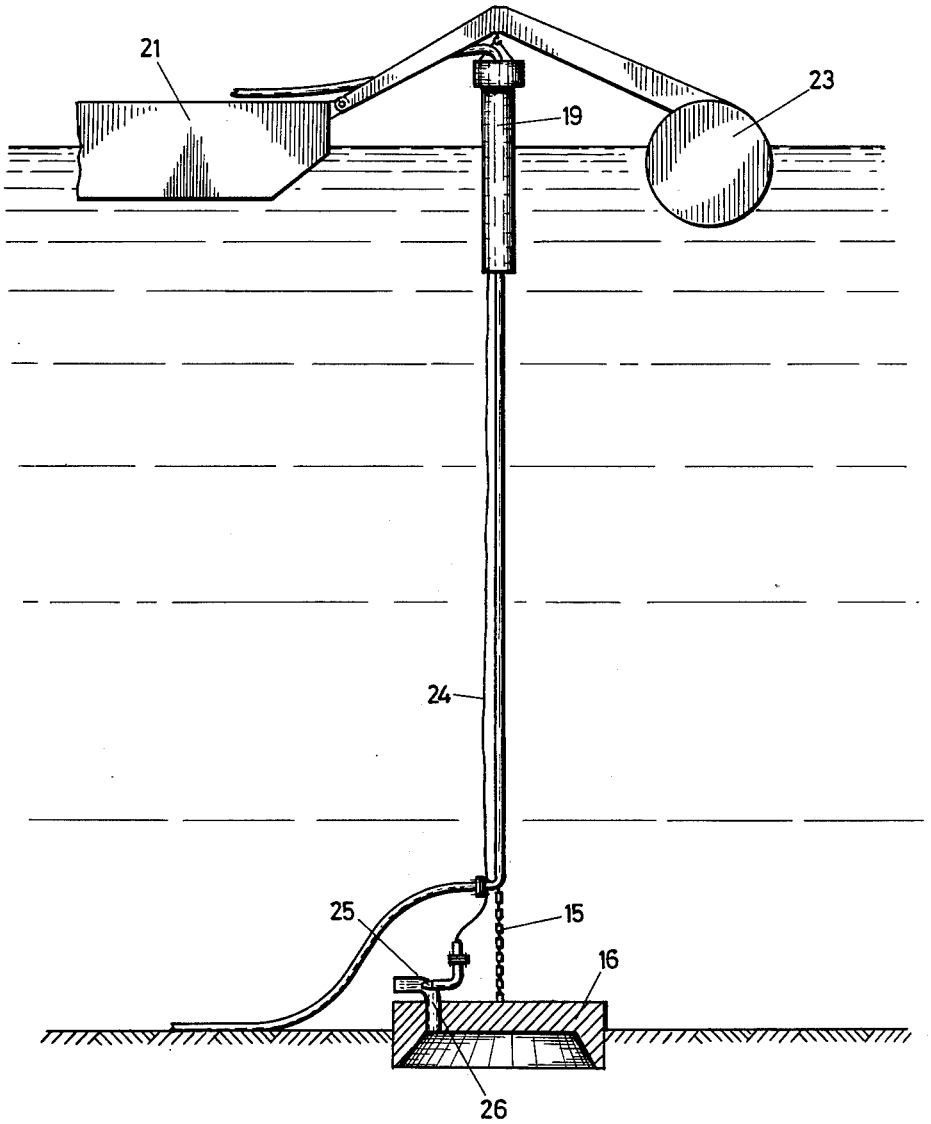
FIG. 3 shows a different embodiment of the invention.

The embodiment of FIG. 3 differs from the embodiment according to FIGS. 1 and 2 in that buoy 19 now is placed between the float 23 and the vessel 21. In this embodiment the influence of the movement of the vessel and the float on the buoy 19 is less.

This figure also schematically shows the action of the jetpumps. The fluid supplied under pressure by the tube 24 is discharged sideways via manifold 25 whereby a vacuum is created and via connection 26 water is sucked in, whereby it is possible to create a vacuum in the anchor.

What we claim is:

1. Mooring means comprising a vessel, rigid arms pivotally mounted on the vessel for vertical swinging movement relative to the vessel about a horizontal axis, a buoy that intersects the surface of the water with a small cross section and that has a height substantially greater than its width and that has a taut but flexible connection with an anchor on the sea floor located directly vertically below the buoy under normally calm sea conditions, universal joint means between the arms and the buoy, and a float connected to said arms at a distance from the buoy and floating in the water.

2. Mooring means as claimed in claim 1, said float being disposed between the buoy and said horizontal axis.

3. Mooring means as claimed in claim 1, said buoy being disposed between said float and said horizontal axis.

4. Mooring means as claimed in claim 1, said buoy being a cylinder.

5. Mooring means as claimed in claim 4, said universal joint means being located at the upper end of said cylinder.

6. Mooring means as claimed in claim 1, wherein the coupling of the rigid arms with the vessel, the coupling of the rigid arms with the buoy and the virtual center of rotation of the float are in the same horizontal plane.

* * * * *